US005230212A

United States Patent [19]

Forestier

[11] Patent Number: 5,230,212

[45] Date of Patent: Jul. 27, 1993

[54] OXIDIZER SUPPLY CONTROL SYSTEM FOR A GAS TURBINE ENGINE

[75] Inventor: Alexandre Forestier, Boissise la Bertrand, France

[73] Assignee: Societe Nationale d'Etude et de Construction de Moteurs "S.N.E.C.M.A.", Valin, France

[21] Appl. No.: 881,807

[22] Filed: May 12, 1992

[30] Foreign Application Priority Data

May 16, 1991 [FR] France ..... 91 05962

[51] Int. Cl.[5] ..... F23R 3/26

[52] U.S. Cl. ..... 60/39.23; 60/748

[58] Field of Search ..... 60/39.23, 39.29, 39.36, 60/39.37, 748

[56] References Cited

U.S. PATENT DOCUMENTS

| | | | |
|---|---|---|---|
| 3,902,315 | 9/1975 | Huellmantel . | |
| 4,534,166 | 8/1985 | Kelm et al. | 60/748 |
| 4,677,822 | 7/1987 | Iizuka et al. | 60/39.23 |
| 4,754,600 | 7/1988 | Barbier et al. | 60/39.23 |
| 4,766,722 | 8/1988 | Bayle-Laboure et al. | 60/39.23 |
| 5,159,807 | 11/1992 | Forestier | 60/39.37 |

FOREIGN PATENT DOCUMENTS 0455559 11/1991 European Pat. Off. .

1945921 3/1971 Fed. Rep. of Germany .

*Primary Examiner*—Richard A. Bertsch
*Assistant Examiner*—Timothy S. Thorpe
*Attorney, Agent, or Firm*—Bacon & Thomas

[57] ABSTRACT

An oxidizer supply control system for a combustion chamber of a gas turbine engine is disclosed wherein a plurality of oxidizer intake diaphragms are regulated by a synchronized, fluid actuated system. The oxidizer intake diaphragms are arranged in pairs and a fluid actuator operates the sleeves of each respective pair of oxidizer intake diaphragms. Synchronization of the movement of all of the sleeves is achieved by a common manifold interconnecting all of the fluid actuators such that they actuate their respective piston rods at substantially the same time with the same amount of movement. Additional synchronization is provided by interconnecting one of the sleeves of a pair of oxidizer intake diaphragms to one of the sleeve members of an adjacent pair of oxidizer intake diaphragms. This ensures that the sleeves all rotate simultaneously. The piston rods of the fluid actuators are connected to a pair of sleeves by a swivel member mounted in housings attached to the adjacent sleeves. A similar swivel member is used to interconnect the sleeves of adjacent pairs of oxidizer intake diaphragms so as to synchronize their movements.

12 Claims, 4 Drawing Sheets

OXIDIZER SUPPLY CONTROL SYSTEM FOR A GAS TURBINE ENGINE

BACKGROUND OF THE INVENTION

The present invention relates to an oxidizer supply control system for controlling the flow of oxidizer into a combustion chamber of a gas turbine engine.

Gas turbine engines are equipped with oxidizer supply systems to supply oxidizer to the combustion chamber. In known fashion, the oxidizer is mixed with a fuel and burned in the combustion chamber. The oxidizer supply system may include a plurality of variable diaphragms to regulate the amount of oxidizer fed into the combustion chamber. These known diaphragms may have a generally cylindrical member defining a plurality of openings through which the oxidizer may pass into the combustion chamber. In known fashion, a sleeve is rotatably attached to an outer surface of the annular member, the sleeve also defining a plurality of openings. Rotation of the sleeve with respect to the cylindrical diaphragm member may place the openings of the sleeve in alignment with those of the diaphragm member to maximize the oxidizer flow into the combustion chamber. By rotating the sleeve member, the alignment of the respective openings may be changed so as to control the oxidizer flow through the diaphragm member.

Such known systems have control devices to control the rotation of the sleeve relative to the diaphragm. A known system shown in European Patent 0 455 559 control adjacent pairs of diaphragms by using a mechanically actuated rod connected to the sleeves of the adjacent pairs. A flexible drive shaft rotates cam elements of a plurality of such actuators to move the piston rods so as to rotate the sleeves and control the flow of oxidizer into the combustion chamber.

While this known system has proven reasonably effective, the mechanical drive system is complex, consisting of many precision components and requires substantial maintenance and repair to maintain its effectiveness.

SUMMARY OF THE INVENTION

An oxidizer supply control system for a combustion chamber of a gas turbine engine is disclosed wherein a plurality of oxidizer intake diaphragms are regulated by a synchronized, fluid actuated system. The oxidizer intake diaphragms are arranged in pairs and a fluid actuator operates the sleeves of each respective pair of oxidizer intake diaphragms. Synchronization of the movement of all of the sleeves is achieved by a common manifold interconnecting all of the fluid actuators such that they actuate their respective piston rods at substantially the same time with the same amount of movement. Additional synchronization is provided by interconnecting one of the sleeves of a pair of oxidizer intake diaphragms to one of the sleeve members of an adjacent pair of oxidizer intake diaphragms. This ensures that the sleeves all rotate simultaneously.

The piston rods of the fluid actuators are connected to a pair of sleeves by a swivel member mounted in housings attached to the adjacent sleeves. A similar swivel member is used to interconnect the sleeves of adjacent pairs of oxidizer intake diaphragms so as to synchronize their movements.

The supply of pressurized fluid to the manifold and, consequentially, to the individual fluid actuators, it is controlled by a valve, which may be a two-position valve. In a first position, pressurized fluid is supplied to the manifold and to each of the fluid actuators so as to move their respective piston rods. In a second valve position, the manifold and the fluid actuators are vented to atmosphere and pressurized fluid is prevented from entering the manifold. The fluid actuators have a piston attached to their respective piston rods which is acted upon on one side by the pressurized fluid from the manifold and on an opposite side by the pressurized oxidizer.

DETAILED DESCRIPTION OF THE PREFERRED EMBODIMENT

The oxidizer supply control system will be described in conjunction with an annular-type gas turbine engine combustion chamber. It is to be understood that the principles disclosed may be utilized with gas turbines having other types of combustion chambers.

Figure 3:
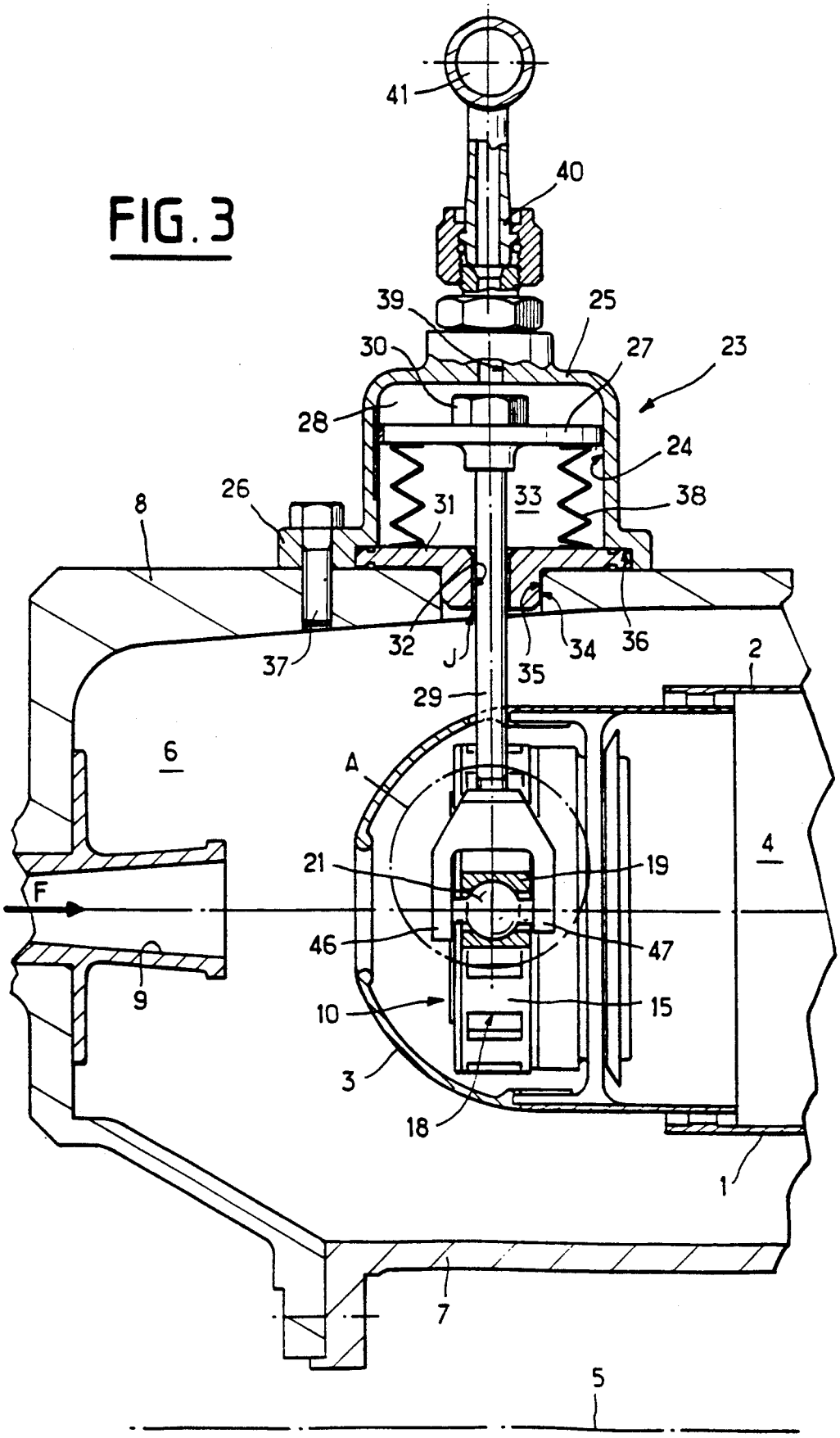
FIG. 3 is a cross-sectional view taken along line III—III in FIG. 2.

The annular combustion chamber 4 of a gas turbine engine is bounded by inner wall 1, outer wall 2 and on an upstream end by end wall 3 (see FIG. 3). The combustion chamber 4, as well as inner and outer walls 1 and 2, are concentric about longitudinal axis 5. An opening in the upsteam end of end wall 3 accommodates, in known fashion, fuel injectors for injecting fuel into the combustion chamber 4. The fuel injectors have been omitted from the drawings for purposes of clarity.

The combustion chamber 4 may be further enclosed within interior chamber 6 of an engine housing defined by inner housing wall 7 and outer housing wall 8, also concentric about longitudinal axis 5. The interior chamber 6 of the housing is supplied with a pressurized oxidizer, generally air taken from a compressor stage of the gas turbine engine, in the direction of arrow F through inlet 9.

Figure 2:
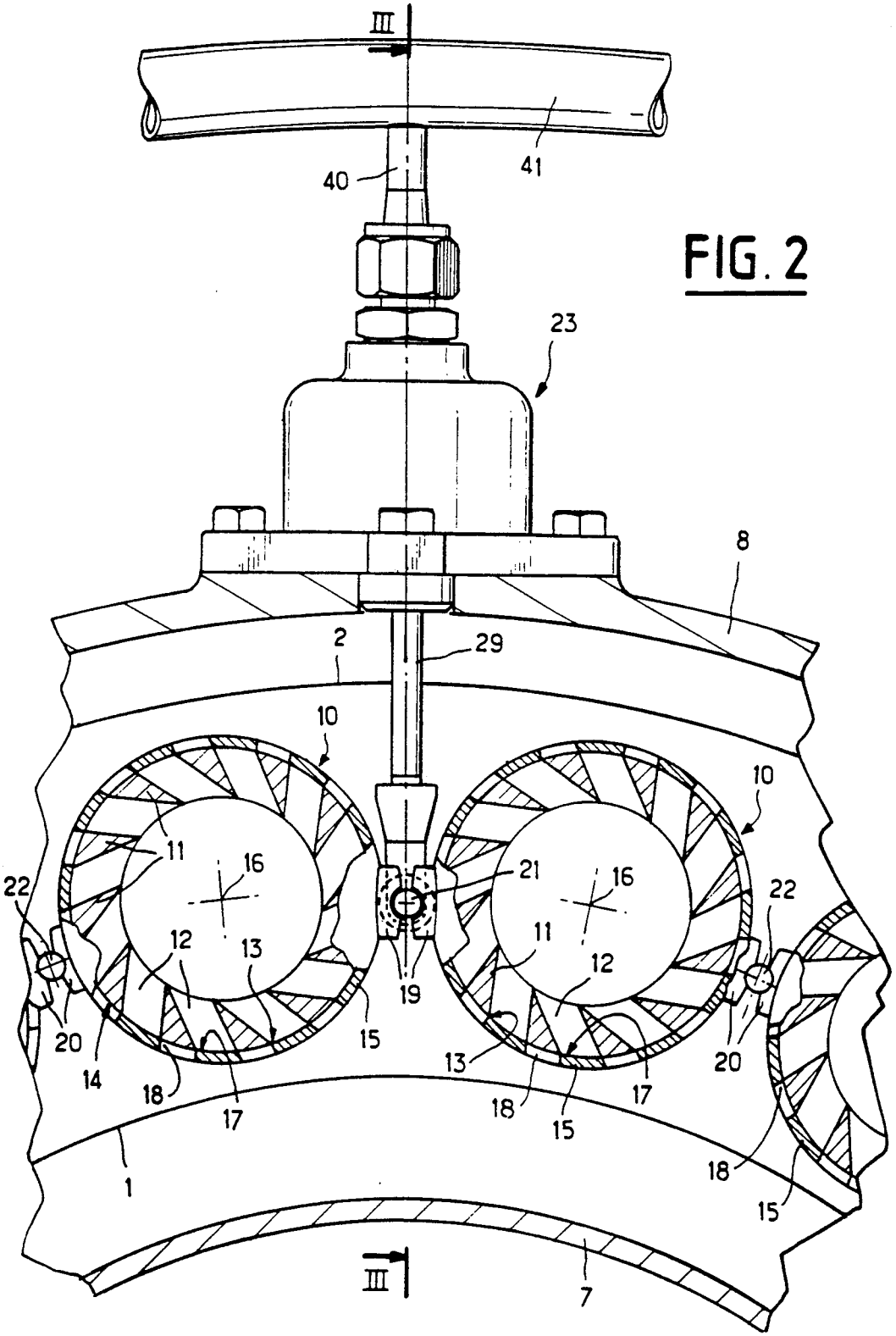
FIG. 2 is a partial, enlarged, lateral cross-sectional view, similar to FIG. 1, illustrating the details of the oxidizer intake diaphragms and their connection to the control system of the present invention.

The oxidizer is supplied to combustion chamber 4 through a plurality of oxidizer intake assemblies 10 arranged in a circular array around longitudinal axis 5. Each of the oxidizer intake assemblies comprises an oxidizer intake 11 defining a plurality of oxidizer intake ducts 12 which communicate with oxidizer intake openings 13 formed through an outer periphery of the oxidizer intake 11. A sleeve 15 is rotatably attached to the outer surface of the oxidizer intakes 11 such that it may rotate with respect thereto about axis 16. As can be seen in FIG. 2, the oxidizer intakes 11, as well as the sleeves 15 are concentric about axis 16. Each sleeve 15 defines a plurality of openings 18 separated by solid areas 17. Rotation of sleeve 15 between two extreme positions will either align the solid areas 17 with the oxidizer intake openings 13, thereby preventing oxidizer from passing through the oxidizer intake 11, or align the holes 18 with the oxidizer intake openings 13, thereby allowing the maximum amount of oxidizer to pass through the oxidizer intakes. Thus, by controlling the rotation of sleeve 15, the amount of oxidizer entering the combustion chamber 4 can be controlled.

Since the oxidizer intake assemblies 10 are located adjacent to each other in their circular array. Adjacent pairs of oxidizer intake assemblies 10 may be controlled by a single actuator. Swivel housings 19 are affixed to the peripheries of sleeves 15 of adjacent oxidizer intake assemblies 10 such that swivel member 21 is accommodated in both of the adjacent swivel housing 19. By attaching the swivel member 21 to a piston rod 29 of fluid actuator 23, linear movement of the rod 29 may be utilized to control the rotating movement of adjacent sleeves 15.

Each of the fluid actuators 23 comprises a cylinder unit 24 of which one end extends transversely to define an end wall 25 attached to outer housing wall 8 via bolts 37 extending through a flange 26. Piston 27 is slidably accommodated within the cylinder 24 and defines a first fluid chamber 28 with the end wall 25. Piston rod 29 is affixed to piston 27 via nut 30 and extends exteriorly of the fluid actuator through hole 32 formed in end 31 of the cylinder. A clearance J is presented between the external surface of piston rod 29 and hole 32. A flexible bellows 38 is located between end 31 and piston 27 so as to define a second or return, operational chamber 33. Chamber 33 communicates with housing interior chamber 6 through the clearance J, enabling the pressurized oxidizer within casing 6 to act on the piston 27 to move it upwardly, as seen FIG. 3, in the absence of pressurized fluid in first operational chamber 28. End 31 of cylinder 24 may comprise a boss 34 which extends into hole 35 defined by the outer housing wall 8.

Flange 26 defines a shoulder 36 such that end 31 is retained in position between shoulder 36 and outer housing wall 8. End wall 25 defines an opening 39 which communicates with the fitting 40 so as to enable pressurized fluid to enter the first operational chamber 28 from the manifold 41. All of the fittings 40 for the various fluid actuators 23 are connected in parallel to the same manifold 41.

Supply of pressurized fluid to the manifold may be controlled by valve 48. Valve 48 is located between a source of pressurized fluid (not shown), which may be compressed air, denoted by arrow G and the manifold 41. Arrow H denotes a fluid return to an unpressurized reservoir, which may be vented to atmosphere if the pressurized fluid is air.

Figure 1:
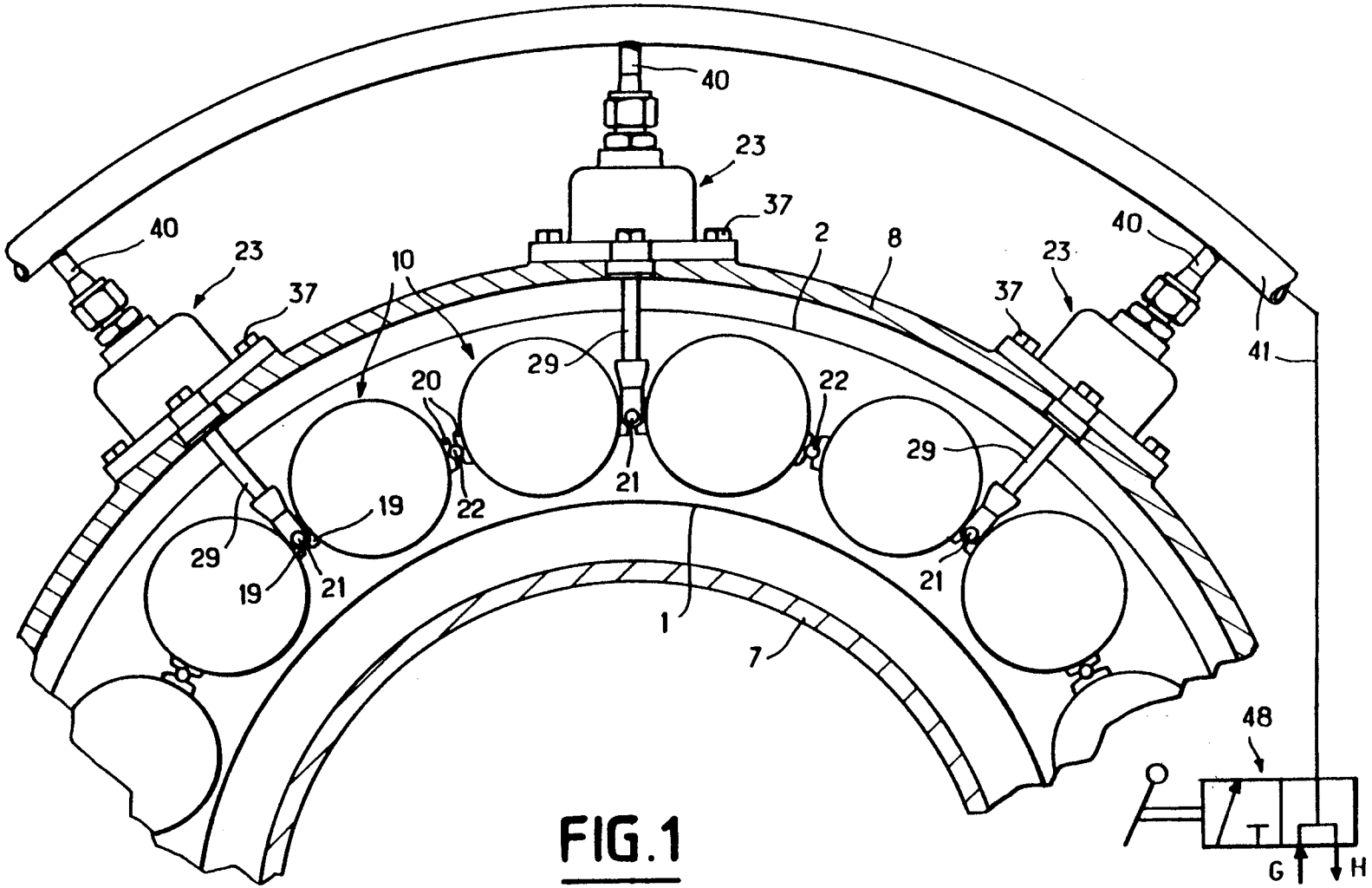
FIG. 1 is a partial, lateral, cross-sectional view of a gas turbine oxidizer supply including the control system according to the present invention.

In the position shown in FIG. 1, valve 48 connects the manifold 41 to the unpressurized reservoir H (which may be vented to atmosphere) and at the same time connects the pressurized fluid source G to the unpressurized reservoir H. In its other position, valve 48 connects the pressurized fluid source G with the manifold 41 and isolates the pressurized fluid source G and the manifold 41 from the unpressurized reservoir H.

Figure 4:
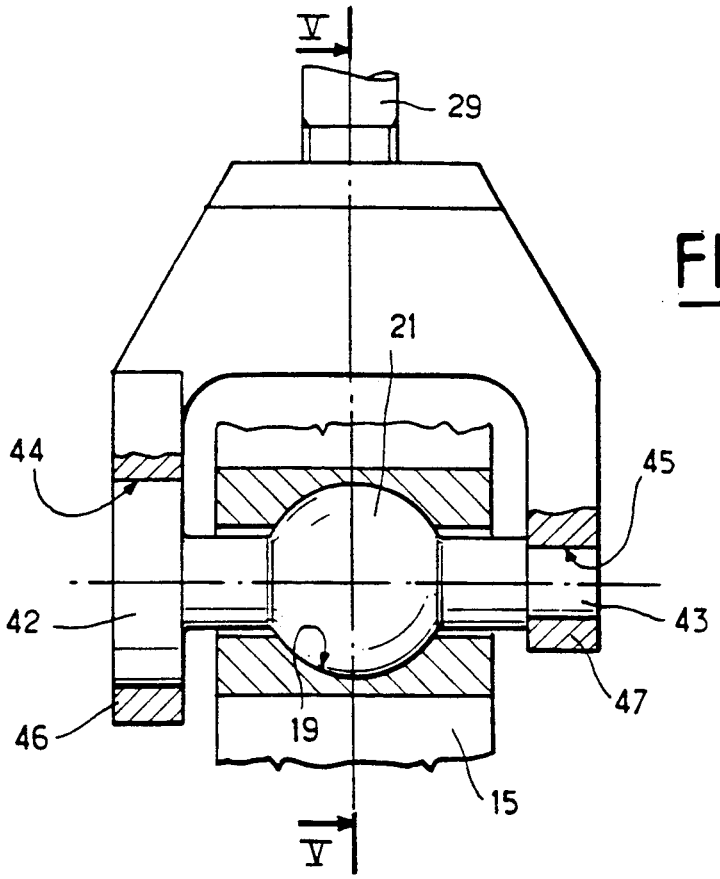
FIG. 4 is an enlarged, cross-sectional view of the connection between the piston rod and the sleeves according to the present invention.
Figure 5:
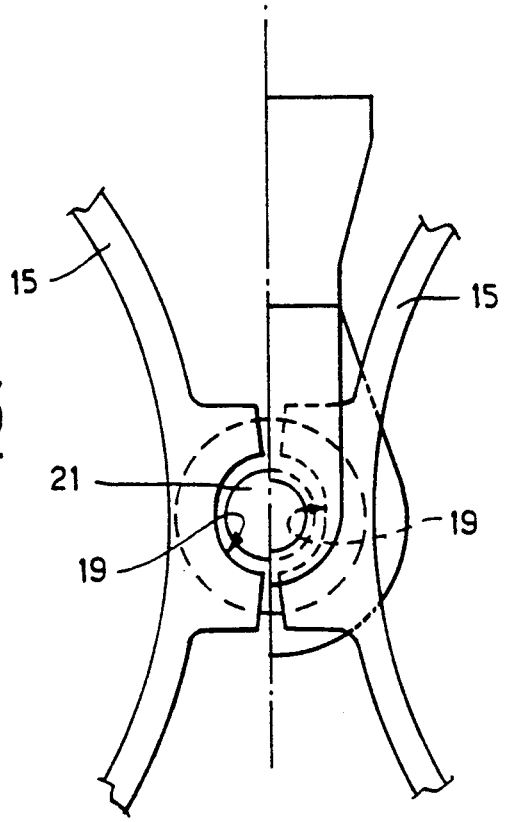
FIG. 5 is a cross-sectional view taken along line V—V in FIG. 4.

Each fluid actuator 23 controls the pivoting or rotational movement of two sleeves 15 through the interaction of swivel member 21 with swivel housing 19. As best illustrated in FIGS. 4 and 5, each swivel member 21 has generally coaxial shafts 42 and 43 extending therefrom in generally opposite directions. Journal bearings 44 and 45 connect the shafts 42 and 43 to arms 46 and 47 of a mounting fork attached to, or formed as part of, an end of piston rod 29. As can be seen, linear movement of piston rod 29 will cause rotation or pivoting movement of sleeves 15 about axes 16.

When no pressurized fluid is being supplied to manifold 41, the sleeves 15 and actuator 23 are in the positions shown in FIGS. 2 and 3. In this position, the solid areas 17 of the sleeves 15 seal the oxidizer intake openings 13. The sleeves are placed in this position by the pressurized oxidizer in chamber 6 acting on piston 27 via second operational chamber 33.

When valve 48 is moved into the position to supply pressurized fluid to the manifold 41, the pressurized fluid enters chamber 28 through fitting 40 and acts on piston 27 to move it downwardly, as seen in FIG. 3. Such movement of the piston and piston rod 29 cause sleeves 15 to pivot about axes 16 such that the openings 18 are in alignment with the oxidizer intake openings 13.

The sleeves associated with each pair of oxidizer intakes must move synchronously, since they are connected to a common piston rod. Similarly, all of the piston rods should move synchronously, since all of the fluid actuators are connected in parallel to a common manifold. To further synchronize the movement of all of the sleeves 15, second swivel housings 20 are mounted on each sleeve 15 in a position generally diametrically opposite swivel housing 19. The second swivel housings 20 are engaged by a second swivel member 22. Thus, the swivel or rotating movement of sleeves 15 of one pair of oxidizer intakes is transmitted to an adjacent pair to ensure that all sleeves move synchronously.

The foregoing description is provided for illustrative purposes only and should not be construed as in any way limiting this invention, the scope of which is defined solely by the appended claims.

We claim:

1. An oxidizer supply control system for a combustion chamber of a gas turbine engine comprising:

a) a plurality of pairs of oxidizer intakes defining oxidizer intake openings adapted to enable oxidizer to pass through the intake openings into the combustion chamber;

b) a sleeve operatively associated with each oxidizer intake, each sleeve movable between a first position in which it closes the oxidizer intake openings and a second position in which it opens the oxidizer intake openings;

c) fluid actuated control means operatively associated with the sleeves of each pair of oxidizer intakes to move the sleeves between their first and second positions wherein the fluid actuated control means comprises:

i) a housing for each pair of oxidizer intakes, each housing defining an interior chamber;

ii) a piston slightly mounted in the interior chamber of each housing;

iii) a piston rod attached to the piston and extending exteriorly of each housing;

iv) attaching means attaching the piston rod to the sleeves associated with the respective pair of oxidizer intakes; and, v) manifold means interconnecting each housing assembly in parallel with a source of pressurized fluid; and, d) synchronizing means connecting a sleeve of an oxidizer intake of one pair of oxidizer intakes with a sleeve of an oxidizer intake of an adjacent pair of oxidizer intakes so as to synchronize the movement of the respective sleeves.

2. The oxidizer supply control system of claim 1 further comprising valve means operatively interposed between the source of pressurized fluid and the manifold means to control the supply of pressurized fluid to the housings.

3. The oxidizer supply control system of claim 2 wherein the valve means comprises a two position valve movable between a first valve position wherein pressurized fluid is supplied to the manifold means and a second valve position wherein the manifold means is vented to an unpressurized reservoir.

4. The oxidizer supply control system of claim 1 wherein the attaching means comprises:

a) a first swivel housing affixed to each sleeve associated with the plurality of pairs of oxidizer intakes;

b) a first swivel member interconnecting each of the first swivel housings in each respective pair of oxidizer intakes;

c) connecting means connecting the first swivel member to a piston rod such that movement of the piston rod causes the sleeves to move between their first and second positions.

5. The oxidizer supply control system of claim 4 wherein the connecting means comprises:

a) shafts extending generally in opposite directions from the first swivel member;

b) a mounting fork attached to the piston rod; and, c) journal means attaching the generally oppositely extending shafts to the mounting fork.

6. The oxidizer supply control system of claim 4 wherein the synchronizing means comprises:

a) a second swivel housing affixed to each sleeve associated with the plurality of pairs of oxidizer intakes; and, b) a second swivel member interconnecting a second swivel housing affixed to a sleeve of one of a pair of oxidizer intakes with a second swivel housing affixed to a sleeve of one of an adjacent pair of oxidizer intakes.

7. The oxidizer supply control system of claim 6 wherein the sleeves are generally annular in configuration and wherein the first and second swivel housings for each sleeve are rigidly affixed in generally diametrically opposite positions.

8. An oxidizer supply control system for a combustion chamber of a gas turbine engine comprising:

a) a plurality of pairs of oxidizer intakes defining oxidizer intake openings adapted to enable oxidizer to pass through the intake openings into the combustion chamber;

b) a sleeve operatively associated with each of the oxidizer intakes, each sleeve movable between a first position in which it closes the oxidizer intake openings and a second position in which it opens the oxidizer intake openings; and, c) fluid actuated control means to move the sleeves between their first and second positions, the fluid actuated control means comprising:

i) a fluid actuator for each pair of oxidizer intakes, each fluid actuator having a housing for each pair of oxidizer intakes, each housing defining an interior chamber; a piston slidably mounted in the interior chamber of each housing assembly; and, a piston rod attached to the piston and extending exteriorly of each housing assembly;

ii) attaching means attaching the piston rod to both sleeves associated with a pair of oxidizer intakes; and, iii) manifold means interconnecting each fluid actuator in parallel with a source of pressurized fluid.

9. The oxidizer supply control system of claim 8, further comprising valve means operatively interposed between the source of pressurized fluid and the manifold means to control the supply of pressurized fluid to the housing assemblies.

10. The oxidizer supply control system of claim 9 wherein the valve means comprises a two position valve movable between a first valve position wherein pressurized fluid is supplied to the manifold means and a second valve position wherein the manifold means is vented to an unpressurized reservoir.

11. The oxidizer supply control system of claim 8 wherein the attaching means comprises:

a) a first swivel housing affixed to each sleeve associated with the plurality of pairs of oxidizer intakes;

b) a first swivel member interconnecting each of the first swivel housings in each respective pairs of oxidizer intakes;

c) connecting means connecting the first swivel member to the piston rod such that movement of the piston rod causes the sleeves to move between their first and second positions.

12. The oxidizer supply control system of claim 11 wherein the connecting means comprises:

a) shafts extending generally in opposite directions from the first swivel member;

b) a mounting fork attached to the piston rod; and, c) journal means attaching the generally oppositely extending shafts to the mounting fork.

* * * * *